US006817067B2

(12) United States Patent
Kopp et al.

(10) Patent No.: US 6,817,067 B2
(45) Date of Patent: Nov. 16, 2004

(54) TANDEM ELECTROHYDROSTATIC ACTUATOR

(75) Inventors: John D. Kopp, West Seneca, NY (US); Thomas P. Neal, Lake View, NY (US)

(73) Assignee: Moog Inc., East Aurora, NY (US)

( * ) Notice: Subject to any disclaimer, the term of this patent is extended or adjusted under 35 U.S.C. 154(b) by 114 days.

(21) Appl. No.: 10/371,079

(22) Filed: Feb. 21, 2003

(65) Prior Publication Data

US 2004/0163386 A1 Aug. 26, 2004

(51) Int. Cl.[7] ..... F15B 13/00
(52) U.S. Cl. ..... 19/508; 91/519; 60/476
(58) Field of Search ..... 60/476, 403, 40; 91/508, 510, 519

(56) References Cited

U.S. PATENT DOCUMENTS 3,073,275 A * 1/1963 Franz et al. ..... 60/476
3,877,347 A * 4/1975 Sheesley et al. ..... 91/438
4,296,677 A * 10/1981 Little et al. ..... 91/519
4,342,164 A * 8/1982 Claassen ..... 60/476

* cited by examiner

*Primary Examiner*—Edward K. Look
*Assistant Examiner*—Igor Kershteyn
(74) *Attorney, Agent, or Firm*—Phillips Lytle LLP

(57) ABSTRACT

A tandem electrohydrostatic actuator (70) broadly includes a first piston (22) operatively arranged in a first cylinder (23), and a second piston (24) operatively arranged in a second cylinder (25). The pistons are coupled to move together. The first piston has a small extend area (35) and a large retract area (36). The second piston has a large extend area (38) and a small retract area (39). The large areas (36, 38) of the pistons are equal to one another and the small areas (35, 39) of the pistons are equal to one another. A reversible fixed-displacement first pump (45) has equal inlet and outlet flows supplied to the small areas of the first and second pistons, respectively. A reversible fixed-displacement second pump (40) has equal inlet and outlet flows supplied to the large areas of the first and second pistons, respectively. The total volume of the fluid in the actuator remains constant at all positions of the pistons. In the preferred embodiment, a connecting rod (26) joins the pistons, an output rod (29) is connected to the first piston and penetrates an end wall (30) of the first cylinder, and a stationary LVDT coil or body (31) has one end attached to an end wall (32) of the second cylinder and has its movable core connected to the connecting rod.

3 Claims, 2 Drawing Sheets

TANDEM ELECTROHYDROSTATIC ACTUATOR

TECHNICAL FIELD

The present invention relates generally to the field of electrohydrostatic actuators ("EHAs") that are particularly adapted for use with aircraft flight control surfaces, and, more particularly, to improved EHAs for tandem electrohydrostatic actuators.

BACKGROUND ART

The present invention provides an improved electrohydrostatic actuator that is particularly suited for use in controlling the position of aircraft flight control surfaces, such as ailerons, flaps, rudders and the like.

Such actuators have been finding increasing application in aircraft where a conventional hydraulic power system is replaced by an all-electric power distribution system. These are sometimes known as "power-by-wire" systems. It has been found that an integrated actuation unit, such as an EHA, that incorporates a controllable electric motor-driven hydraulic pump connected to a conventional hydraulic actuator, offers the potential for improved reliability and reduced maintenance costs of the overall flight control system.

FIG. 1 is a schematic diagram of a conventional EHA, and shows a typical tandem piston/cylinder driven by two hydraulic pumps operated by separate controllable electric motors (not shown). This figure also illustrates another significant aspect of the typical EHA design, namely, the use of an unbalanced-area piston in the cylinder nearest to the unit mounting point, which minimizes the overall length of the actuator. This requires a so-called "folded tail-rod" (i.e., a tube having one end fixed and having its opposite marginal end portion telescopingly received in the piston connecting rod) which can be used to contain an electrical position feedback transducer, such as a linear variable differential transformer ("LVDT"). This design requires a modification of the fixed-displacement/variable-speed pump, since displacing the unequal piston areas necessitates the transfer of the area-difference fluid into, or out of, a reservoir.

An effective means of dealing with the unequal-area problem is to add a small pump that is mechanically ganged to the main pump. The small pump controls a portion of the large-area flow to and from the reservoir. The ratio of the combined pump displacements to the main-pump displacement is equal to the piston area ratio. The result is nominally-matched pump/piston flow.

In some prior art systems, the equivalent of the added pump has been the use of a so-called "3-port" pump in which the pump cylinder porting has been modified so that a portion of the piston stroking is connected to return. While this appears somewhat simpler, it suffers from the generation of pressure spikes that can be detrimental to actuator life.

U.S. Pat. No. 4,296,677 discloses an actuator having two unbalanced-area pistons in a back-to-back arrangement in which the output rod and the folded tail-rod are of equal diameter and the common piston connecting rod is somewhat larger. This configuration is similar to that of the present invention, but the '677 patent makes clear that the mirror-image area-unbalance was intended for use with a conventional tandem flow-control valve and dual hydraulic pressure system to insure that the total actuator output force, when both hydraulic system pressures are available, would be equal in both the extend and retract directions. The '677 patent also incorporates typical structural isolation, or "rip-stop", of parts associated with the separate hydraulic systems.

DISCLOSURE OF THE INVENTION

The subject invention eliminates the need for a secondary pump (and its associated oversized reservoir) by reducing the diameter of the external piston rod to match the area of the folded tail-rod. This piston area arrangement is, coincidentally, the same as that disclosed in the aforesaid '677 patent, but for an entirely different reason. The inventive arrangement has each motor-driven pump connected to a pair of equal piston areas; i.e., the two piston end areas are used as one pair and the two piston center areas as the other pair. Thus, each pump has identical inlet and outlet flows at all times, even though the flows are different from one another. Ideally, the pumps would have their displacements proportioned to the piston areas, so that their rotational speeds could be identical. However, experience has shown that producing equal pump displacements in the proper ratio by running the pumps at different speeds is an entirely workable solution.

With parenthetical reference to the corresponding parts, portions or surfaces of the embodiment disclosed in FIG. 2, the present invention broadly provides an improved tandem electrohydrostatic actuator (70).

The improved actuator broadly includes: a first piston (22) operatively arranged in a first cylinder (23); a second piston (24) operatively arranged in a second cylinder (25), the pistons being coupled to move together; the first piston having a small extend area (35) and a large retract area (36); the second piston having a large extend area (38) and a small retract area (39); the large areas (36, 38) of the pistons being substantially equal to one another and the small areas (35, 39) of the pistons being substantially equal to one another; a reversible fixed-displacement first pump (45) having equal inlet and outlet flows supplied to the small-area of the first piston and to the small-area of the second piston, respectively; and a reversible fixed-displacement second pump (40) having equal inlet and outlet flows supplied to the large-area of the first piston and to the large-area of the second piston, respectively; whereby the total volume of fluid in the actuator will remain substantially constant at all positions of the pistons.

In the preferred embodiment, the actuator further comprises a connecting rod (26) joining the pistons, an output rod (29) connected to the first piston and sealingly and slidably penetrating an end wall (30) of the first cylinder, and a fixed rod (31) having one end attached to the end wall (32) of the second cylinder and having its opposite marginal end portion telescopingly received in the second piston and in the connecting rod.

Accordingly, the general object of the invention is to provide an improved tandem electrohydrostatic actuator.

Another object is to provide an improved tandem electrohydrostatic actuator in which each pump is connected to paired piston areas which are equal, even though the actuator has a fixed tail-rod.

Another object is to provide an improved electrohydrostatic actuator in which each pump is of conventional 2-port design.

Another object is to provide an improved electrohydrostatic actuator in which fluid transfer between the main circuit and the reservoir is primarily due to pump internal leakage, thereby eliminating reservoir "pumping" as the ram strokes and greatly reducing its size and improving its fatigue life.

Another object is to provide an improved electrohydrostatic actuator in which the total volume of fluid in each reservoir remains substantially constant at all positions of said pistons.

Another object is to provide an improved electrohydrostatic actuator in which overboard leakage at the cylinder centerdam is eliminated, thereby reducing the reservoir depletion rate.

Another object is to provide an improved electrohydrostatic actuator in which the potentially-damaging levels of pressure ripples, produced by 3-port pumps, are eliminated.

These and other objects and advantages will become apparent from the foregoing and ongoing written specification, the drawings, and the appended claims.

DESCRIPTION OF THE PREFERRED EMBODIMENTS

Figure 1:
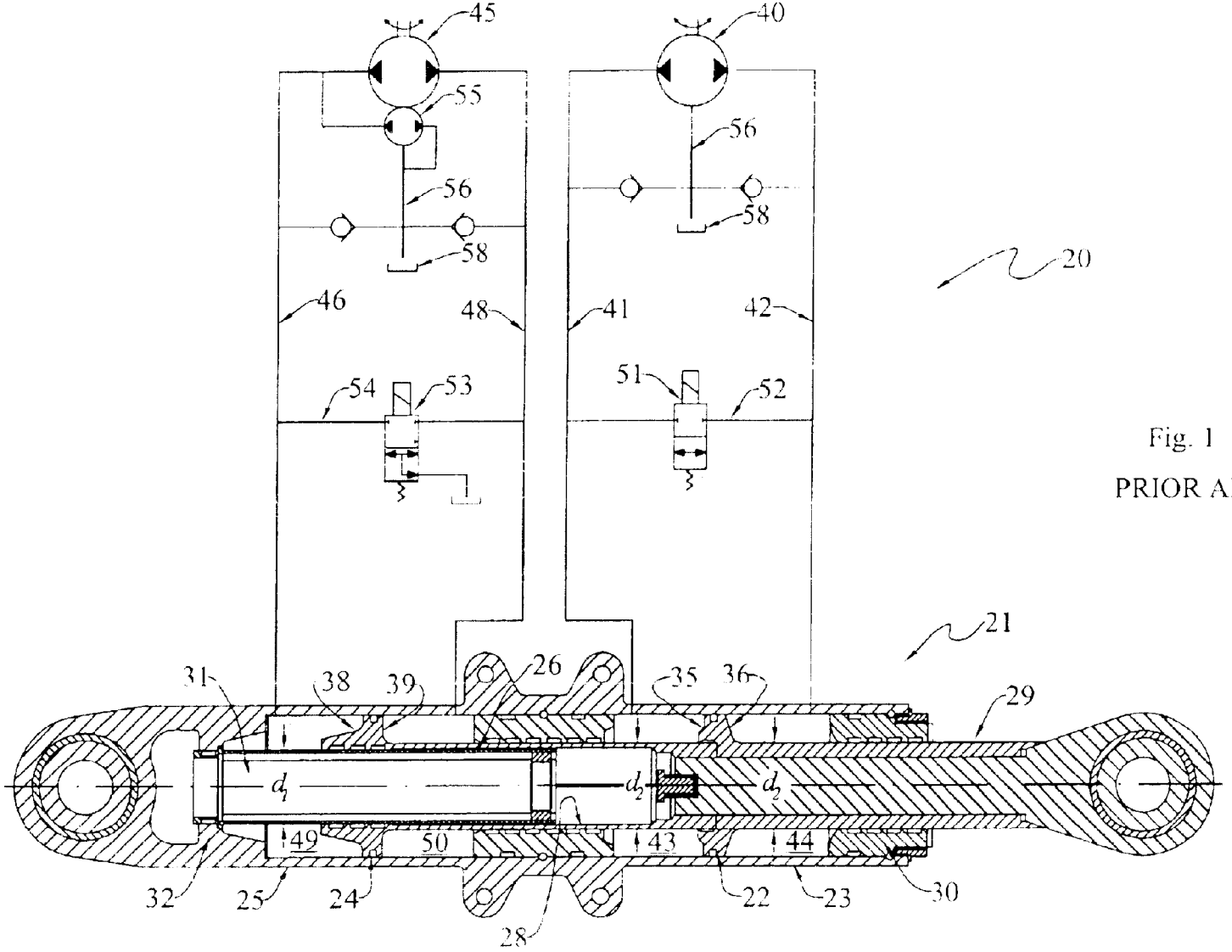
Fig. 1 PRIOR ART
FIG. 1 is a schematic view of a prior art tandem electrohydrostatic actuator, this view showing two separate motor-driven pumps as controlling the flows of fluid with respect to the opposed chambers of the respective pistons.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Prior Art Embodiment (FIG. 1)

Referring now to FIG. 1, a prior art tandem electrohydrostatic actuator is generally indicated at 20.

This actuator included a tandem fluid-powered actuator, generally indicated at 21. More particularly, actuator 21 had a rightward first piston 22 mounted for sealed sliding movement within a first cylinder 23, and had a leftward second piston 24 mounted for sealed sliding movement within a second cylinder 25. A large-diameter connecting rod 26 joined the two pistons, and sealingly and slidably penetrated an intermediate common cylinder wall 28.

The first piston was connected to an output rod 29 that sealingly and slidably penetrated a rightward end wall 30 of the first cylinder. As used herein, to "extend" means to move output rod 29 rightwardly relative to cylinder wall 30 so as to extend the output rod, whereas to "retract" means to move output rod 29 leftwardly relative to this cylinder wall. A position-sensing device, such as an LVDT, had its stationary coil portion 31 fixed to the left end wall 32 of second cylinder 25, and had its rightward movable core portion 33 connected to rod 29. LVDT body 31 was of diameter $d_1$, and connecting rod 26 and output rod 29 were both of diameter $d_2$. Thus, the first piston 22 had equal-area faces 35, 36 facing into opposing chambers 43, 44, respectively. More particularly, the first piston 22 had a leftward small extend area 35 and a rightward small retract area 36. However, the second piston had unequal-area faces 38, 39 facing into opposed chambers 49, 50, respectively. More particularly, second piston 24 had a rightward small retract area 39 and a leftward large extend area 38. In the foregoing description, "small" and "large" are used in a relative sense.

A first motor-driven pump 40 communicated via conduits 41, 42 with the extend and retract chambers 43, 44 of the first piston. Similarly, a second motor-driven pump 45 communicated via conduits 46, 48 with the extend and retract chambers 49, 50, respectively, of the second piston. An electrically-controlled bypass valve 51 was arranged in a conduit 52 connecting conduits 41, 42. Similarly, another electrically-operated bypass valve 53 was arranged in a conduit 54 connecting conduits 46, 48, respectively.

In this prior art arrangement, the two motor-driven pumps 40, 45 were arranged to control the flows of fluid with respect to the extend and retract chambers of the associated actuator 21. Thus, to extend the output rod (i.e., to move it rightwardly relative to the cylinder), pump 40 was rotated in one direction to pump fluid from first piston retract chamber 44 through conduit 42, pump 40 and conduit 41 to first piston extend chamber 43. At the same time, pump 45 was rotated in the appropriate direction to pump fluid from second piston retract chamber 50 through conduit 48, pump 45, and conduit 46 to second piston actuator extend chamber 49. Because first piston areas 35, 36 were equal, such flow from the first piston retract chamber equalled the flow into the first piston extend chamber. However, because of the differential areas 38, 39 of the second piston, the flow from second piston retract chamber 50 was less than the flow required by second piston extend chamber 49.

To accommodate this, a supplemental pump 55 was associated with pump 45. Pump 55 was arranged to pump fluid via conduit 56 with respect to a tank 58. When it was desired to extend the output rod, the flow from retract chamber 50 was less than the flow than needed to be supplied to extend chamber 49. Hence, supplemental pump 55 would draw differential-flow make-up fluid from the tank 58, and provide it to chamber 49. Conversely, when it was desired to retract the rod, the flow from chamber 49 would exceed the flow needed into retract chamber 50. Hence, pump 55 would be operated in the opposite direction to pump the differential flow through conduit 56 to the tank. Thus, supplemental pump 55 was used to add or remove, as appropriate, the differential flow of fluid with respect to the second piston.

The two bypass valves 51, 53 were electrically-controlled solenoid valves, that could be selectively energized (e.g., in the event of a failure of the associated pump) to permit communicating flows between the opposed chambers of each piston. The bypass valve 53 used with the unbalanced area piston was a three-way valve to provide the necessary desired flow.

Thus, in this prior art arrangement, the unequal-area relationship of piston 24 created a differential flow which was accommodated by operation of supplemental pump 55 in the appropriate direction.

Figure 2:
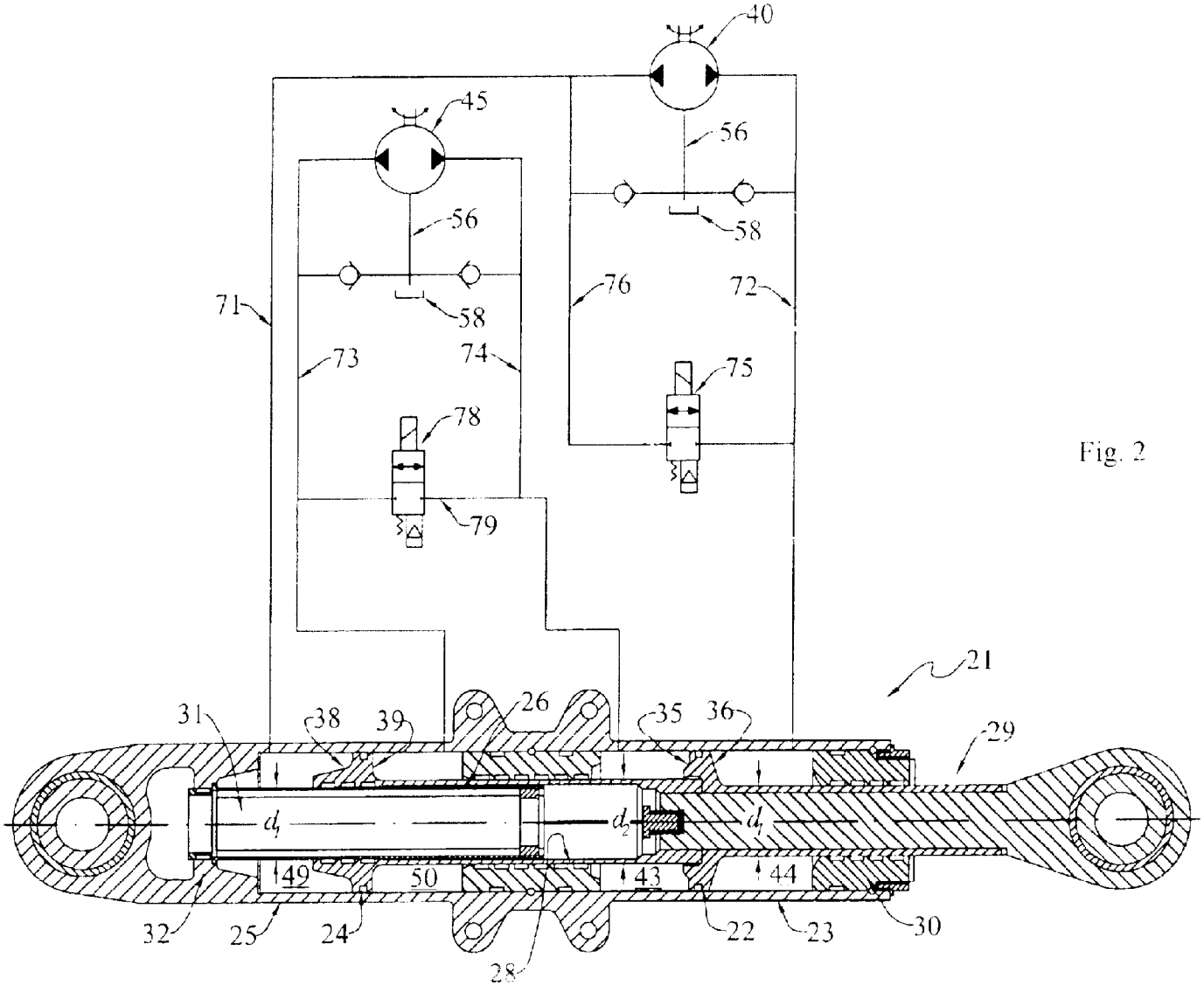
FIG. 2 is a schematic view of the improved tandem electrohydrostatic actuator, showing the two pumps as controlling the flows with respect to the same-area chambers.

Improved Actuator (FIG. 2)

Referring now to FIG. 2, an improved tandem electrohydrostatic actuator is generally indicated at 70.

Inasmuch as many of the parts and components of this improved arrangement have been previously shown and described, the same reference numeral will be used to refer to corresponding structure previously described. Any differences will be specifically noted.

Actuator 21 differs from that shown in FIG. 1 in that rods 29, 31 are both of diameter $d_1$. Connecting rod 26 has a diameter $d_2$. Hence, first piston large-area 36 equals second piston large-area 38, and first piston small-area 35 equals second piston small-area 39.

In this second arrangement, supplemental pump 55 has been eliminated. Pump 40 communicates with second piston extend chamber 49 via conduit 71, and communicates with first piston retract chamber 44 via conduit 72. Similarly, pump 45 communicates via conduit 73 with second piston retract chamber 50, and communicates via conduit 74 with first piston extend chamber 43. In other words, in the improved arrangement, the large-area chambers 49, 44 of both pistons communicate via pump 40, and the small-area chambers 43, 50 of the actuator communicate via pump 45. An electrically-operated bypass valve 75 is operatively arranged in conduit 76 that communicates conduit 72 with conduit 71. Similarly, another electrically-operated bypass valve 78 is arranged in a conduit 79 that communicates with conduits 73, 74.

Thus, in the inventive embodiment, the flow with respect to (i.e., into and out of) first piston chamber 44 will be substantially equal to the flow with respect to second piston chamber 49 because first piston area 36 is equal to second piston area 38. Similarly, the flow with respect to first piston chamber 43 will be substantially the same as that with respect to second chamber 50 because first piston small-area 35 is the same as second piston small-area 39. Thus, the inventive arrangement avoids the need to make-up or account for a differential flow due to unequal area pistons.

If either of the pumps were to become jammed or inoperative, the appropriate bypass valve 75 or 78, which need only be a two-way valve, could be energized to limit control to the other hydraulic system.

Modifications

The present invention contemplates that many changes and modifications may be made. For example, the actuator cylinders might be modified to incorporate a passive "fail-center" valving port. Similarly, the bypass valves may be either electrically- or fluidicly-operated.

A variant of the invention is to use 3-port pumps, connected to the dual-unbalanced cylinder in the conventional manner. While not eliminating the need for 3-port parts, it avoids the need for two different pump sizes and/pro mismatched rotational speeds.

Therefore, while the presently-preferred form of the improved tandem electrohydrostatic actuator has been shown and described, and several modification thereof discussed, persons skilled in this art will readily appreciate that various additional changes and modifications may be made without departing from the spirit of the invention, as defined and differentiated by the following claims.

What is claimed is:

1. A tandem electrohydrostatic actuator, comprising:

a first piston operatively arranged in a first cylinder;

a second piston operatively arranged in a second cylinder, said pistons being coupled to move together;

said first piston having a small extend area and a large retract area;

said second piston having a large extend area and a small retract area;

said large areas of said pistons being substantially equal to one another and said small areas of said pistons being substantially equal to one another;

a reversible fixed-displacement first pump selectively operable to supply substantially equal inlet and outlet flows to the small areas of the first and second pistons, respectively; and a reversible fixed-displacement second pump selectively operable to supply substantially equal inlet and outlet flows to the large areas of the first and second pistons, respectively;

whereby the total volume of fluid in said actuator remains substantially constant at all positions of said pistons.

2. A tandem electrohydrostatic actuator as set forth in claim 1 and further comprising:

a connecting rod joining said pistons, an output rod connected to said first piston and sealingly penetrating an end wall of said first cylinder, and a fixed rod attached to an end wall of said second cylinder and telescopingly received in said second piston and said connecting rod.

3. A tandem electrohydrostatic actuator as set forth in claim 2 wherein the diameters of said output and fixed rods are substantially equal.

* * * * *